US005164739A

United States Patent [19]

Koide et al.

[11] Patent Number: 5,164,739

[45] Date of Patent: Nov. 17, 1992

[54] ANTENNA DEVICE FOR AN AUTOMOBILE

[75] Inventors: Hideshi Koide; Yuichi Murakami; Kiyokazu Ieda; Kazuo Sato, all of Aichi, Japan

[73] Assignee: Aisin Seiki K.K., Kariya, Japan

[21] Appl. No.: 678,097

[22] Filed: Apr. 1, 1991

[30] Foreign Application Priority Data

Mar. 31, 1990 [JP] Japan ..... 2-85881

[51] Int. Cl.[5] ..... H01Q 1/100; H01Q 5/000

[52] U.S. Cl. ..... 343/901; 343/715; 343/749

[58] Field of Search ..... 343/711, 712, 714, 715, 343/901-903, 722, 858, 905, 906, 749, 790, 791, 792

[56] References Cited

U.S. PATENT DOCUMENTS

| | | | |
|---|---|---|---|
| 4,200,874 | 4/1980 | Harada | 343/715 |
| 4,675,687 | 6/1987 | Elliot | 343/903 |
| 4,734,703 | 3/1988 | Nakase et al. | 343/715 |
| 4,742,360 | 5/1988 | Carolus | 343/715 |
| 4,968,991 | 11/1990 | Yamazaki | 343/715 |
| 5,017,935 | 5/1991 | Hayashi et al. | 343/715 |

FOREIGN PATENT DOCUMENTS 0009205 1/1988 Japan .

*Primary Examiner*—Rolf Hille
*Assistant Examiner*—Peter Toby Brown
*Attorney, Agent, or Firm*—Sughrue, Mion, Zinn, Macpeak & Seas

[57] ABSTRACT

An antenna device is comprised of a base member fixed to an automobile body, a first mast member, a second mast member and a third mast member. The third mast member is supported by the base member, the second mast member is supported by the third mast member and includes a plurality of telescopic elements and the first mast member is supported by one end of the second mast member and located away from the automobile body. A feeder conductor is connected to the first mast member through an impedance matching coil with the feeder conductor and the coil being molded in a resin elevation member. The resin elevation member extends through the second and third mast members and has an enlarged portion which surrounds the coil. The enlarged portion of the resin elevation member is in engagement with the second mast member and elevates the second mast member upon movement away from the automobile body.

2 Claims, 4 Drawing Sheets

ANTENNA DEVICE FOR AN AUTOMOBILE

BACKGROUND OF THE INVENTION

The present invention relates to an antenna device for an automobile which is installed in the automobile body.

A conventional antenna device, for example, is disclosed in Japanese Kokai No. 62-17920. The conventional device integrates an antenna mast for an AM/FM radio receiver and another antenna mast for an automobile telephone. The telephone antenna mast, which transmits and receives shorter wave lengths than the antenna mast for a radio receiver, is located close to an automobile body. The automobile body is equivalent to a grounded plate. Therefore, the telephone antenna mast may be affected by the automobile body if the telephone antenna mast is close to the automobile body. As a result of this, the most sensitive direction of the telephone antenna mast is not directed horizontally. Therefore, the telephone antenna mast may be less sensitive.

In order to solve the above drawback, the telephone antenna mast may be located away from the automobile body 1. Such an antenna device is disclosed in Japanese Kokai No. 64-77205. In such an antenna device, as shown in FIG. 6 of the present application, the telephone antenna mast 1 is fixed onto the top of the radio antenna mast 2 in order to locate the telephone antenna mast 1 away from the automobile body 3. The telephone antenna mast 1 is electrically connected to an automobile telephone unit 5 via coaxial cable 4.

The coaxial cable 4 has to be thinner than the AM/FM antenna mast 2 since the coaxial cable 4 is inserted in the AM/FM antenna mast 2. The coaxial cable 4 has a feeder conductor 4*a* and a shielded conductor which surrounds the feeder conductor. Thus, in the conventional antenna device, the coaxial cable 4 has a large transmissive loss since the feeder conductor has to be very thin.

SUMMARY OF THE INVENTION

Accordingly, one of the objects of this invention is to obviate the above conventional drawbacks. Further, one of the objects of this invention is to reduce the transmissive loss of the feeder conductor.

Generally, when the shielded conductor is omitted, the impedance of the feeder conductor is varied due to varying of the inner diameter of the second and third antenna masts. The varied impedance of the feeder conductor causes refraction in the feeder conductor. The refraction increases the loss of the feeder conductor. However, in the present invention, the feeder conductor has a tapered shape in order to make the impedance of the feeder conductor constant in spite of the variation of the inner diameter of the third and second antenna masts. Therefore, no refraction is generated in the feeder conductor. Thus the loss of the feeder conductor is reduced.

The foregoing and other objects, features and advantages of the invention will be apparent from the following more particular description of a preferred embodiment of the invention as illustrated in the accompanying drawings.

DETAILED DESCRIPTION OF THE INVENTION

Figure 1:
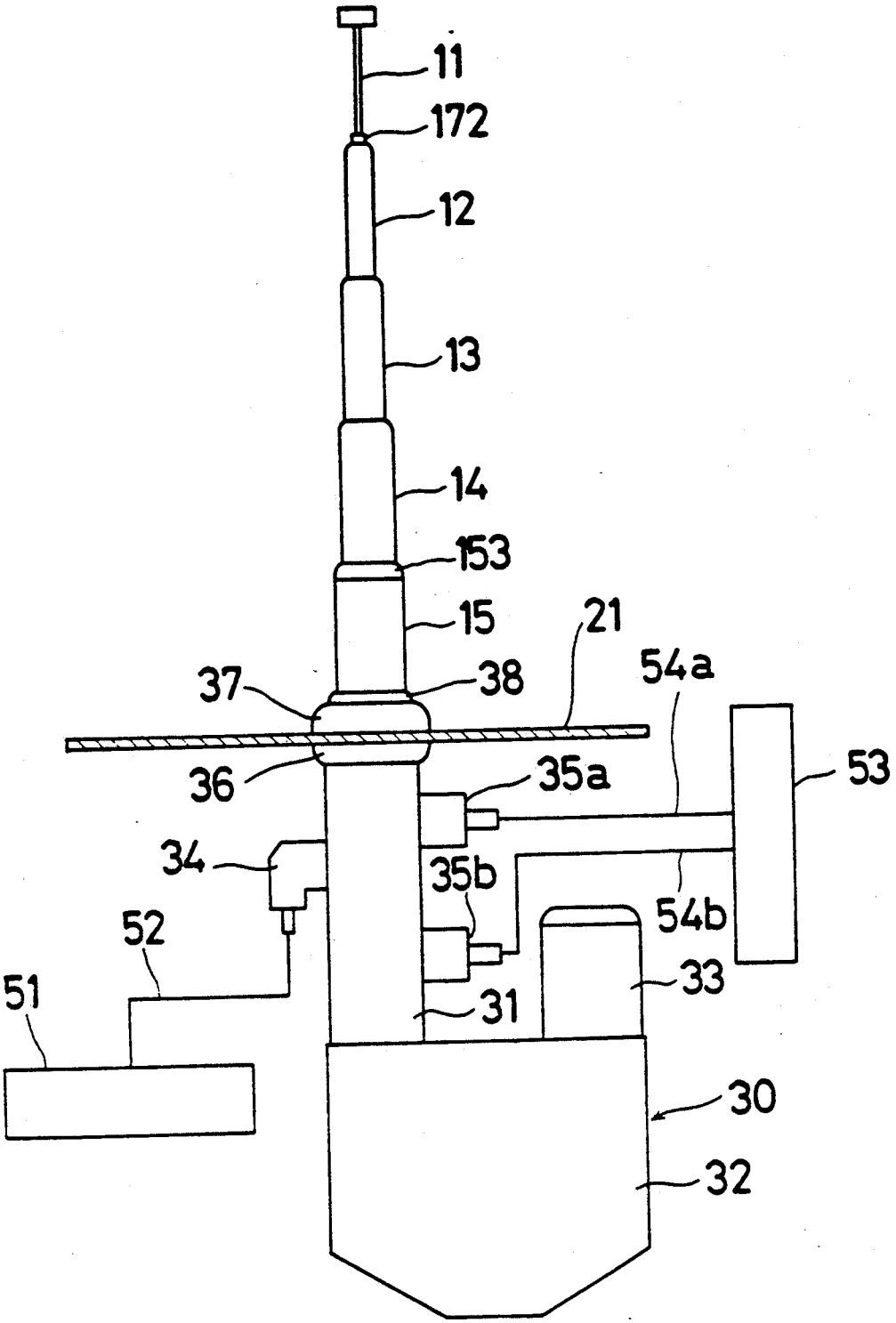
FIG. 1 is a side elevational view showing an antenna device of the present invention.

FIG. 1 is a side elevational view of an antenna device of the present invention. A base member 30 is fixed to an automobile body plate 21. The base member 30 has a metallic tube member 31, a wire housing member 32 which is fixed to the metallic tube member 32 and a motor 33 which is fixed to the wire housing member 32. An antenna terminal 34 is connected to the FM/AM radio receiver 51 through the coaxial cable 52. An automobile telephone unit 53 is connected to the antenna terminals 35*a*, 35*b* through coaxial cables 54*a*, 54*b*. The automobile telephone unit 53 has a capability of diverse reception.

A metallic flange 36 is fixed to the tube member 31. A fixing member 37 is screwed to the flange 36. The base member 30 is secured to the body plate 21 by clamping the body plate 21 between the flange 36 and the fixing member 37.

A tubular sleeve 38 is fixed to the fixing member 37. The sleeve 38 is made from non-conductive material. The non-conductive sleeve 38 supports the lower most element 15 slidably. The element 15 slidably supports an element 14. The element 14 slidably supports an element 13. The element 13 slidably supports an element 12. These elements 15, 14, 13 and 12 constitute a telescopic mechanism. Further, the elements 15, 14, 13 and 12 become thinner toward the element 11.

Figure 2:
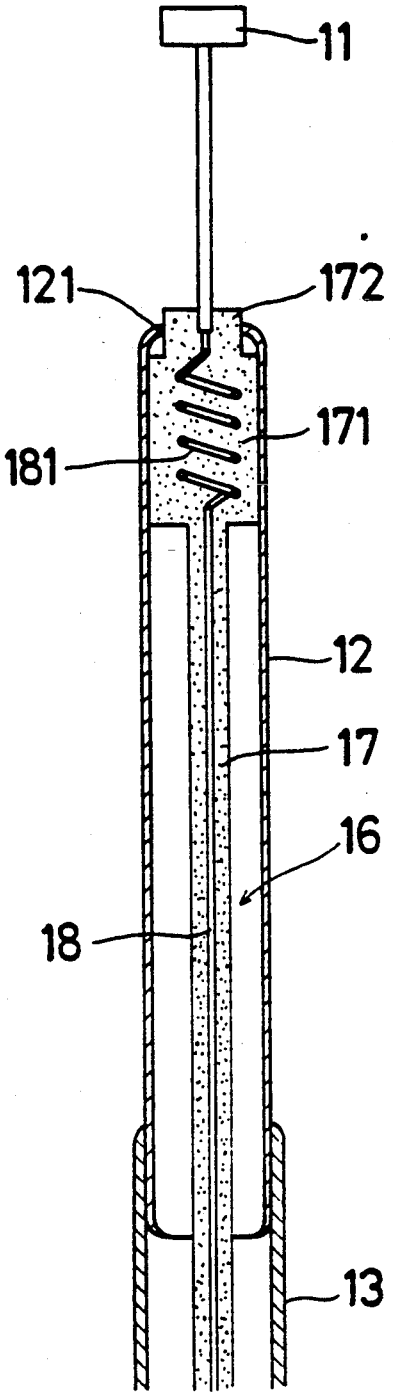
FIG. 2 is a cross sectional view showing an element of the antenna device in the extended position.

Referring now to FIG. 2, a continuous space 16 is provided in the elements 15, 14, 13 and 12. An elevation member 17 is inserted in the space 16. The elevation member 17 is made of resin. A feeder conductor 18 is molded in the elevation member 17. A large diameter portion 171 and a small diameter portion 172 are formed on one end of the elevation member 17. A matching coil 181 is molded in the large diameter portion 171 in order to match the impedance between the element 11 and the feeder conductor 18. The small diameter portion 172 is projected from the opening 121 at one end of the element 12.

Figure 3:
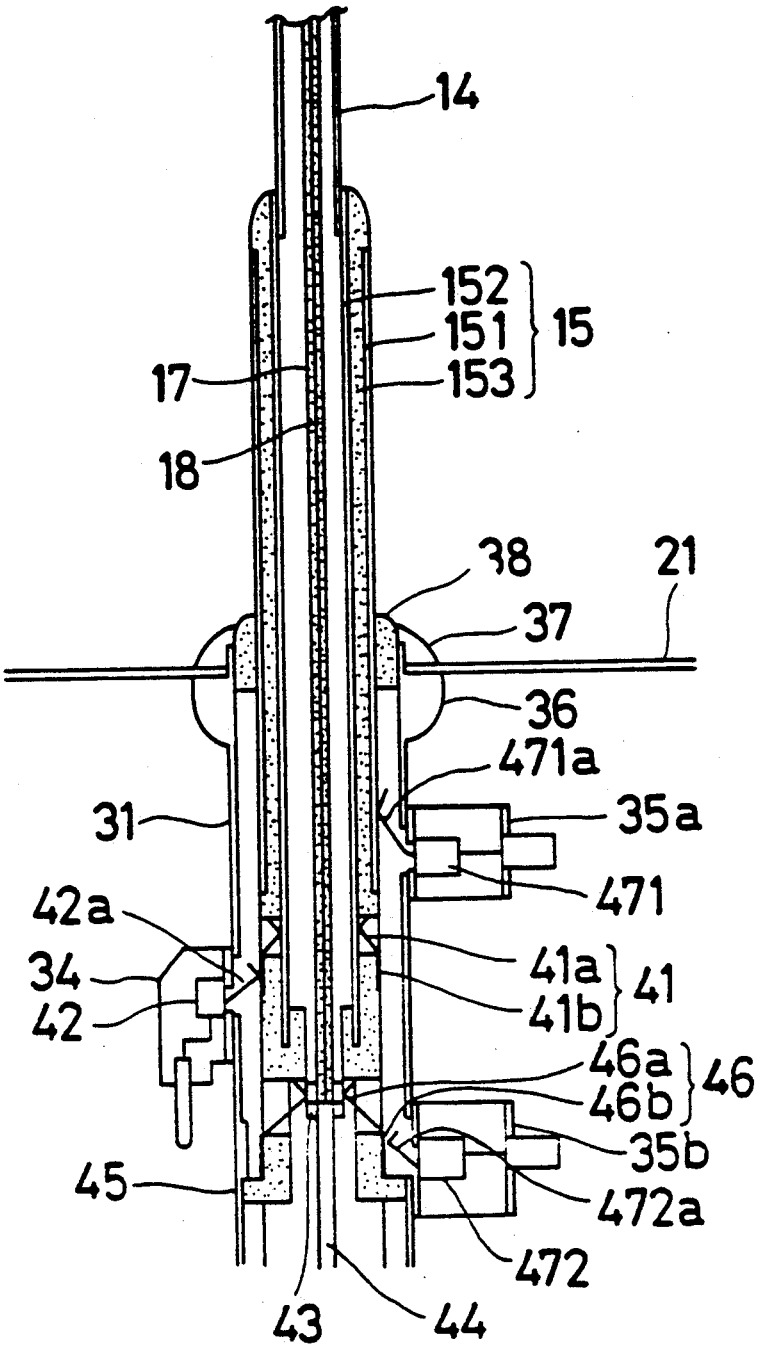
FIG. 3 is a cross sectional view showing a tube member of the antenna device in the retracted position.

Referring to FIG. 3, the antenna element 15 is inserted in the tubular sleeve 38. The antenna element 15 comprises an outer conducting sleeve 151, an inner conducting sleeve 152 and an isolating sleeve 153 which is provided between the outer and the inner conducting sleeves 151, 152. A contact collar 41 is molded in the isolating sleeve 153. One end 41*a* of the contact collar 41 has contact with the inner conducting sleeve 152. Further, the other end 41*b* of the contact collar 41 is exposed on an outer circumference of the isolating sleeve 153.

A low pass filter 42 is installed in the antenna terminal 34 for the FM/AM radio receiver 51. The low pass filter 42 prevents an electric wave for telephone 53 from leaking through the antenna terminal 34 to the FM/AM radio receiver 51. An input electrode 42*a* of the low pass filter 42 has a contact with the end 41*b* of the contact collar 41.

A high pass filter 471 is installed in the antenna terminal 35*a*. The high pass filter 471 prevents an electric wave for the FM/AM radio receiver 51 from leaking through the antenna terminal 35*a* to the automobile telephone 53. An input electrode 471*a* of the high pass filter 471 contacts with the outer conducting sleeve 151.

An end metallic member 43 is fixed to the lower end of the elevation member 17. An end of the feeder conductor 18 is electrically connected to the end metallic member 43. The end metallic member 43 mechanically connects to the elevation member 17 to a resin wire 44.

An antenna stopper 45 is pressed into the metallic tube member 31. A contact collar 46 is fixed to the antenna stopper 45. An end 46*a* of the contact collar 46 contacts the end metallic member 43.

A high pass filter 472 is installed in the antenna terminal 35*b*. The high pass filter 472 prevents an electric wave for FM/AM radio receiver 51 from leaking through the antenna terminal 35*b* to automobile telephone 53. The input electrode 472*a* of the high pass filter 472 contacts with the other end 46*b* of the contact collar 46.

Figure 4:
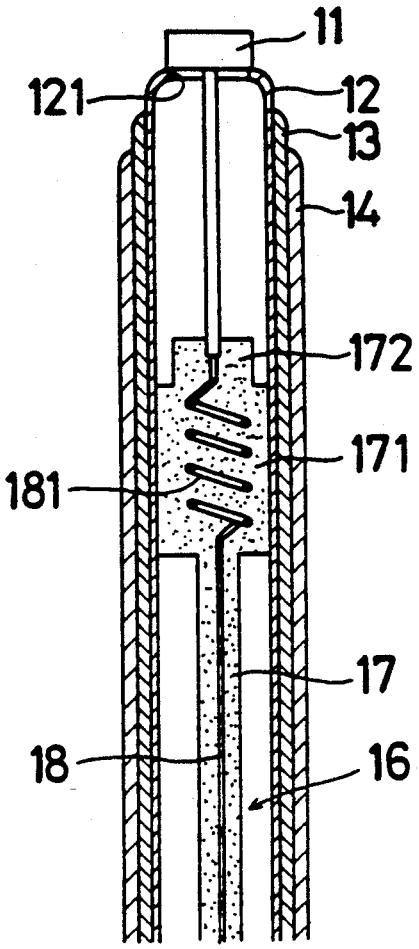
FIG. 4 is a cross sectional view showing an element of the antenna device.

The resin wire 44 is wound around a pulley (not shown). When the motor 33 is operated in one direction, the resin wire 44 retracts the lower end of the elevation member 17 in order to telescope the elements 15, 14, 13, 12 and 11. At this time, as shown in FIG. 4, the elevation member 17 slides in the element 12 and the element 11 is housed in the element 12. The elements 12, 13, 14 and 15 are housed orderly according to the movement of the elevation member 17 since the element 11 has a larger diameter head portion than the opening 121.

If the motor 33 is driven in the opposite direction, the resin wire 44 begins to push the elevation member 17 in the upward direction, thereby causing the extension of the elements 11–15. At this time, as shown in FIG. 2, the sliding movement of the elevation member 17 within the element 12 pushes out the element 1 therefrom. Since the large diameter portion 171 is larger than the opening 121 in diameter, the elements 12–15 are brought into extension in turn as the elevation member 17 moves in the upward direction.

The element 11 and the outer conducting sleeve 151 each receive a half-length of an intermediate wavelength of the telephone band. The element 11 is used for transmission a nd reception and the sleeve 151 is used for receiving in this band. When the element 11 receives the telephone signal, the resulting signal is output to the telephone unit 53 via the conductor 18 within the tube member 31, metallic member 43, the contact collar 46 and the high bypass filter 472. The telephone signal received by the sleeve 151 is also output to the telephone unit 53 via the high bypass filter 471. The telephone unit 53 then begins to perform the diverse reception by utilizing or combining these signals for establishing the minimum degradation due to fading.

In light of the high frequency for the telephone band, the elements 12–14, the sleeve 152 and the plate 21 constitute a capacitor. Thus, the elements 12–14 and the sleeve 152 act as shielding means to prevent the overlay of noise at the feeder conductor.

Though the element 11 and the sleeve 151 are out of direct electrical contact with the elements 12–14, in the FM/AM band, elements 12–14 and the feeder conductor 18 constitute a capacitor and the sleeve 151 and the sleeve 152 also constitute a capacitor. Thus, the elements 11–15 as a whole act as an antenna for the FM/AM receiver. Signals received by the resulting antenna are transmitted to the receiver 51 via the collar 41 and the low pas filter 42.

Figure 5:
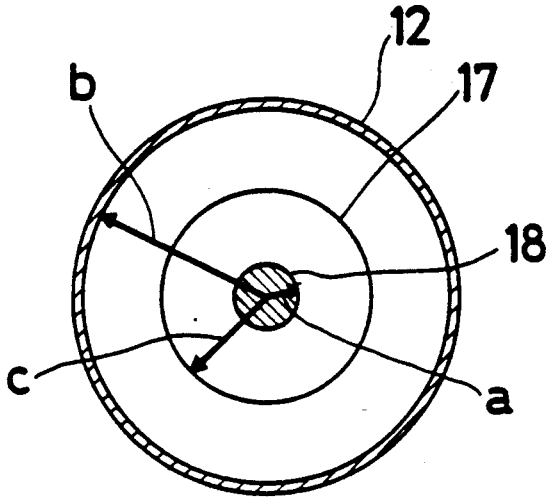
FIG. 5 is a cross sectional view of an element of the antenna device.
Figure 6:
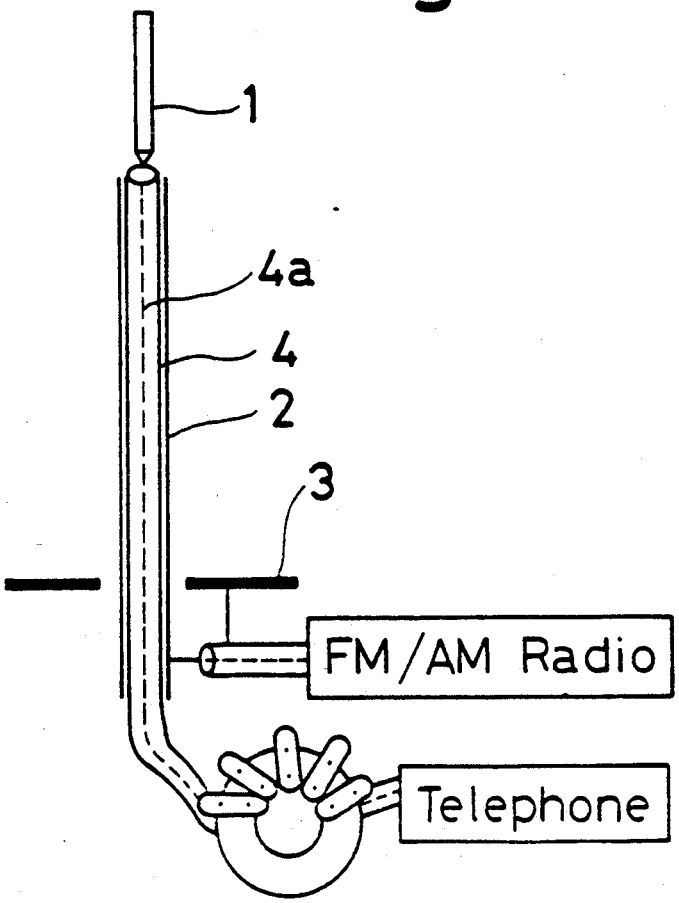
FIG. 6 is a cross sectional view showing a conventional antenna device.

For preventing the weakening of the signal received by the element 11, in this embodiment, the feeder conductor is formed in a tapered configuration. As shown in FIG. 5, the impedance Z of the feeder conductor 18 can be expressed by the following formulas:

$$Z = 138\ \{\mathrm{LOG}(b/c) + \mathrm{LOG}(c/a)/\sqrt{Er}) - 138\ \mathrm{LOG}(1/c^{\sqrt{Er}} -) \cdot b^{\sqrt{Er}}/a)\}$$

where "a" is a diameter of the feeder conductor 18, "b" is an inner radius of the element 12 "c" is a diameter of the elevation member 17 and "Er" is a dielectric constant of the elevation member 17. Thus, constant impedance can be obtained along the whole length of the feeder conductor 18 by adjusting the tapered configuration thereof and setting the diameter of the elevation member 17 so as to comply with the following expressions or equations:

$$b^{\sqrt{Er}}/a + R\,1\ (\text{constant})$$

$$c = R\,2\ (\text{constant})$$

Therefore, variations in the radius "b" does not establish reflections in the feeder conductor 18 which leads to the effective feeding of the signal to the telephone unit 53.

It is noted that the most sensitive direction of the sleeve 15 differs from that of the element 11 due to the effect of the plate 21. In detail, the former is oriented to the horizontal direction and contrary to this, the latter is oriented to an oblique upward direction. This difference enables the effective reduction of the degradation in the reception due to fading by employment of the diverse reception in the telephone unit 53.

While the invention has been particularly shown and described with reference to preferred embodiments thereof, it will be understood by those in the art that the foregoing and other changes in form and details may be made therein without departing from the spirit and scope of the invention.

What is claimed is:

1. An antenna device comprising:

a base member fixed to an automobile body;

a first mast member;

a second mast member;

a third mast member, the third mast member being supported by the base member;

the second mast member being supported by the third mast member and having a plurality of telescopic elements;

the first mast member being supported by one end of the second mast member and located remote from the automobile body; and a feeder conductor connected to said first mast member through an impedance matching coil, said feeder conductor and said coil being molded in a resin elevation member, the resin elevation member extending through said second and third mast member and having an enlarged portion surrounding said coil in engagement with said second mast member for elevating said second mast member upon movement away from said automobile body.

2. An antenna device according to claim 1, wherein the second mast member and the third mast member, both of conductive material, provide shielding means for the feeder conductor to reduce noise.

* * * * *